United States Patent [19]

Silvey

[11] Patent Number: 4,821,480

[45] Date of Patent: Apr. 18, 1989

[54] ADJUSTABLE SIDEWALL CONNECTION FOR ROOF PANEL SUPPORT JOISTS

[75] Inventor: James L. Silvey, Kansas City, Mo.

[73] Assignee: Butler Manufacturing Company, Kansas City, Mo.

[21] Appl. No.: 201,016

[22] Filed: Jun. 1, 1988

[51] Int. Cl.[4] ..... E04G 25/00

[52] U.S. Cl. ..... 52/632; 52/262; 52/655

[58] Field of Search ..... 52/262, 272, 287, , 52/288, 289, 632, 643, 648, 650, 655, 690, 693

[56] References Cited

U.S. PATENT DOCUMENTS

| | | |
|---|---|---|
| 1,233,743 | 7/1917 | Arndt . |
| 2,793,720 | 5/1957 | Hawes . |
| 3,029,913 | 4/1962 | Liesenfeld . |
| 3,062,340 | 11/1962 | Hunnebeck . |
| 3,209,508 | 10/1965 | Hunnebeck . |
| 3,221,461 | 12/1965 | Grunfeld . |
| 3,325,957 | 6/1967 | Demeules et al. . |
| 3,704,846 | 12/1972 | Clark . |
| 3,727,362 | 4/1973 | Ellison et al. . |
| 4,003,179 | 1/1977 | Gilb . |
| 4,077,176 | 3/1978 | Bauer . |
| 4,682,460 | 7/1987 | Reetz . |
| 4,683,698 | 8/1987 | Churchman . |

*Primary Examiner*—David A. Scherbel
*Assistant Examiner*—Jerrold D. Johnson
*Attorney, Agent, or Firm*—Shoemaker and Mattare, Ltd.

[57] ABSTRACT

An adjustable sidewall connection for roof joists includes a plurality of diverging braces connected at one of their ends to substantially the same location on the joist and diverging at their other ends to three spaced apart points of attachment to the sidewall, thereby bracing the joist against movement in a direction parallel to the plane of the sidewall and providing support to the sidewall in a direction perpendicular to the plane of the sidewall. The adjustable connection spans the space between the joist and adjacent sidewall in those constructions where the distance between sidewalls is not divisible by four (the nominal width of each joist).

7 Claims, 2 Drawing Sheets

ADJUSTABLE SIDEWALL CONNECTION FOR ROOF PANEL SUPPORT JOISTS

FIELD OF THE INVENTION

This invention relates to frame structures, and more particularly, to a building frame structure in which an adjustable connection is provided between a roof joist or truss frame system and a sidewall of the building.

PRIOR ART

Various frame designs and systems are known in the prior art for the construction of buildings. One such system which is particularly suitable in the construction of roofs is described in applicant's prior U.S. Pat. No. 4,683,698. This patent discloses a frame system in which roof panel supporting joists comprise upper and lower elongated chord members with connecting webs extending therebetween. The webs are disposed on approximately 45° angles to form a delta configuration when viewed either in plan or elevation. This joist system offers a simple, economical alternative to traditional bar joist construction for load-bearing concrete or masonry projects, and utilizes lightweight, prepunched trusses which may be quickly and easily assembled on the ground and then lifted and bolted in place. Pre-punched holes maintain accurate alignment of the frame system and roof panels. It further provides diaphragm bracing which enables a standing seam roof system to be employed in which unique clips are used to provide for thermal expansion and contraction. Moreover, such a system uses conventional modular construction concepts, providing flexibility in design.

Although the above-described frame system is suitable in building constructions wherein the building width is divisible by four, if the side walls of the building are not so spaced custom parts must be provided to span the gap or space between the sidewall and the truss system. This requirement adds complexity and expense to the building construction.

This same problem of accommodating variations in the space between the side walls of a building and the adjacent ends of space frames or roof trusses when the building width is not divisible by four applies also to other prior art systems. Moreover, in some instances it may be necessary to provide some means of adjustment between the frame and building sidewall due to unintended construction variations in building dimensions.

A number of prior patents have sought to solve the problem of matching such frames to building side walls. Examples of some such solutions are described in the following U.S. Pat. Nos.: 1,233,743, 2,793,720, 3,029,913, 3,062,340, 3,209,508, 3,221,461, 3,325,957, 3,704,846, 3,727,362, 4,003,179, 4,077,176, and 4,682,460. Each of U.S. Pat. Nos. 2,793,720, 3,325,957, 4,003,179, 4,077,176 and 4,682,460, for instance, disclose truss or joist constructions in which the length of the truss or joist can be adjusted through a bolt and slotted connection. The adjustment provided by such an arrangement is limited to only a few inches in most cases, and the truss or joist constructions and hanger connections shown in these patents do not provide the lateral and vertical support achieved with the present invention. U.S. Pat. No. 3,221,461 describes a beam construction in which a telescopic section is clamped by a bolt and guide channel design to enable longitudinal adjustment of the beam length. U.S. Pat. Nos. 1,233,743, 3,029,913, 3,062,340 and 3,209,508 all teach arrangements which provide for adjustment of truss or girder members, including turnbuckle arrangements (U.S. Pat. Nos. 3,209,508 and 3,029,913) and/or telescoping sections or threaded sleeves (U.S. Pat. No. 3,062,340). In addition, the three last-mentioned patents disclose arrangements in which an angularly inclined brace extends between the upper and lower chords and is angularly adjustable to accommodate length adjustments in the top chord.

U.S. Pat. Nos. 3,704,846 and 3,727,362 are merely of interest and are not believed to suggest any of the novel features of the present invention.

SUMMARY OF THE INVENTION

Accordingly, it is an object of this invention to provide an adjustable sidewall-to-joist connection which enables the joist to be quickly and easily connected to the sidewall without requiring custom adapters or parts.

Another object of the invention is to provide an adjustable connection between a truss or joist and a sidewall, in which the adjustable connection provides strength and rigidity in directions both perpendicular and parallel to the plane of the wall.

Yet another object of the invention is to provide an adjustable connection between a joist system and the sidewall of a building, in which the connection provides three-point contact with the wall at vertically and horizontally spaced positions, thereby providing a rigidly braced connection which resists movement of the truss in a direction parallel to the plane of the wall and which also provides support to the sidewall in a direction perpendicular to the plane of the sidewall.

A further object of the invention is to provide an adjustable connection for spanning the distance between a truss or joist system and the sidewall of a building, in which the joist has upper and lower chords interconnected by diagonally extending webs, and bottom chord ties extending laterally to the chords beneath the bottom chord, wherein at least one pivoted truss member is angularly connected between the bottom chord and the sidewall, and a bottom chord tie extension extends between the end of the bottom chord tie and the sidewall to brace the joist against movement both parallel and perpendicular to the sidewall.

An even further object of the invention is to provide an adjustable connection for attaching a joist to a sidewall, in which the joist includes upper and lower chords interconnected by diagonally extending webs forming a delta configuration, and bottom chord ties extending laterally to the bottom chords, the connection including a length extension from the bottom chord tie to the sidewall and a pair of diagonally extending, pivoted braces or truss members extending from the end of the bottom chord tie to the sidewall, thereby providing means for spanning the space between the joist and the sidewall when the distance between sidewalls is not divisible by four and also preventing movement of the joist in a direction parallel to the sidewall and providing support to the sidewall in a direction perpendicular to the plane of the sidewall.

BRIEF DESCRIPTION OF THE DRAWINGS

These and other objects and advantages of the invention will become apparent from the following detailed description when considered with the accompanying drawings, in which like reference characters designate like parts the several views, and wherein.

DETAILED DESCRIPTION OF THE PREFERRED EMBODIMENTS

Figure 1:
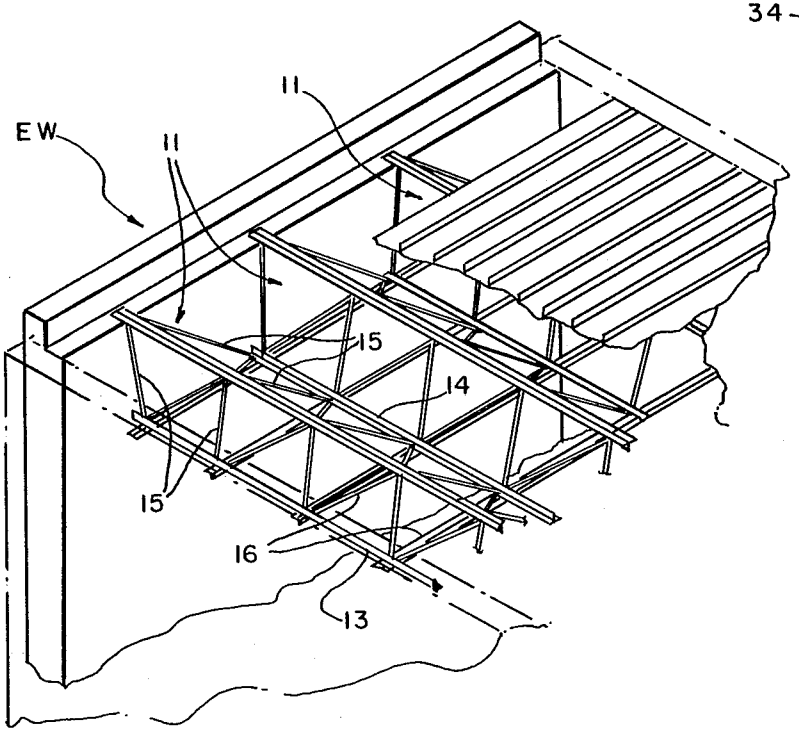
FIG. 1. (PRIOR ART)
FIG. 1 is a fragmentary, partly sectional perspective view of a prior art joist system which may utilize the adjustable connection of the invention.

Referring more particularly to the drawings, a roof-supporting joist system of the so-called "delta" configuration is indicated generally at 10. As more fully described in applicant's prior patent 4,683,698, this system provides a number of advantages over other joist structures. Each joist 11 comprises a top chord 12 and a pair of laterally spaced apart bottom chords 13 and 14, with diagonally extending webs 15 interconnecting the chords to form a delta configuration. Bottom chord ties 16 extend beneath the bottom chords in transverse relationship thereto. In use, the joists are placed so that the chords extend longitudinally between the end walls EW, one of which is shown in FIG. 1. The joists, as manufactured, are four feet wide and may have any desirable length, up to sixty feet. Thus, in order for the joists to fit the span between a pair of sidewalls SW, the distance between the sidewalls must be divisible by four. Otherwise, there will be a space between the joists and the sidewall or sidewalls. In conventional systems, this space is spanned by custom parts and/or adapters.

Figure 4:
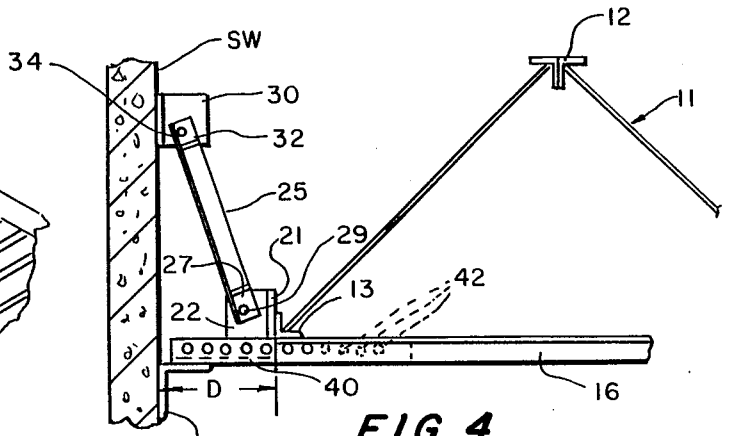
FIG. 4 is a view similar to FIG. 3, showing the adjustable connection contracted to accommodate close spacing of sidewalls.
Figures 2, 5:
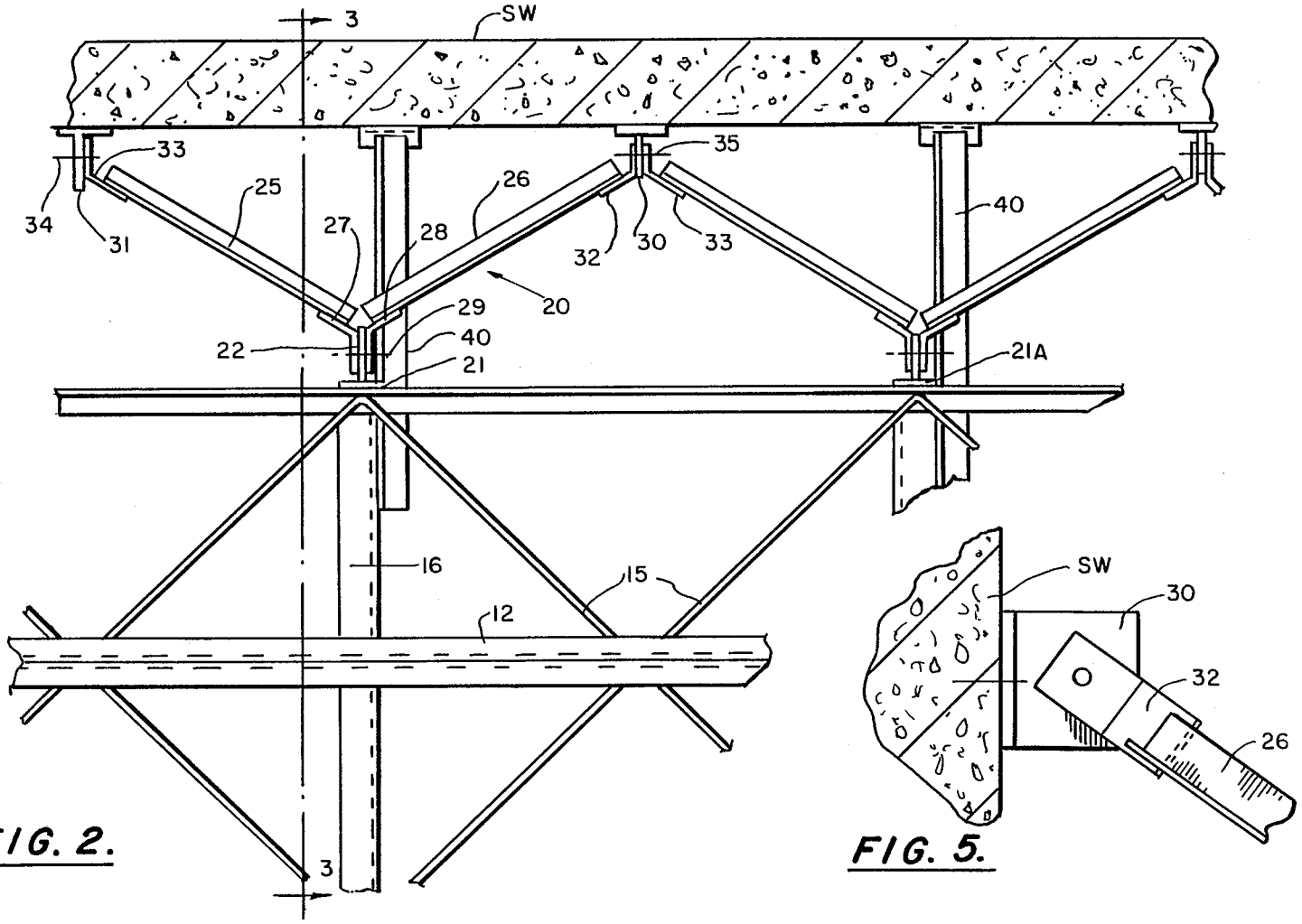
FIG. 2 is a greatly enlarged, fragmentary plan view of the adjustable connection of the invention, shown in use with the joist construction of FIG. 1.
FIG. 5 is a further enlarged, fragmentary sectional view of the connection of the pivoted truss member to the sidewall, taken along line 5—5 in FIG. 2.

In accordance with the present invention, and as seen best in FIGS. 2–5, an adjustable connection 20 is provided between the side of the joist 11 and the adjacent side wall SW. The adjustable connection comprises a T-shaped mounting bracket 21 which is suitably fixed to the side of the bottom chord 13 or 14 with the leg 22 of the bracket extending laterally from the chord toward the adjacent sidewall. The bracket is affixed to the chord 13 or 14 at the point where the chord tie 16 extends beneath the chord, as seen in FIG. 2.

Figure 3:
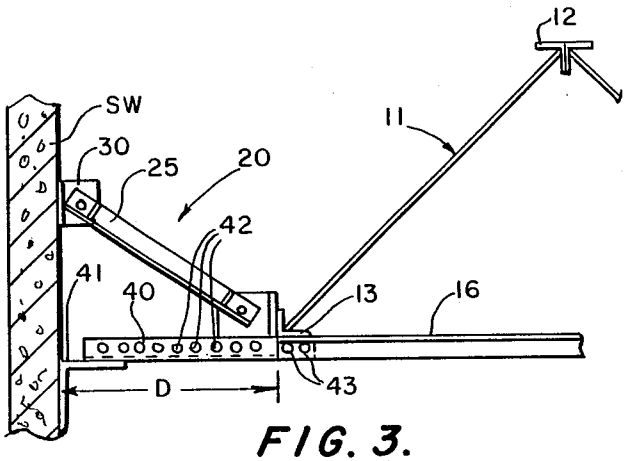
FIG. 3 is a fragmentary view in section, on reduced scale, taken along line 3—3 in FIG. 2, and showing the connection maximum extended position.

A pair of angularly upwardly and outwardly extending truss members or braces 25 and 26 are connected to the bracket 21 on opposite sides of the leg 22 by means of angle shaped plates 27 and 28 and a bolt 29 extended through the plates and the leg 22 of the bracket. This connection enables the truss members 25 and 26 to be pivoted up and down about the bolt 29, increasing or decreasing the horizontal reach of the truss members relative to the adjacent sidewall. Thus, as seen in FIG. 3, the truss members 25 and 26 may be pivoted in a downward direction to achieve a maximum reach or distance D of two feet between the sidewall and the joist 11. Alternatively, as seen in FIG. 4, the truss members 25 and 26 may be pivoted upwardly about the bolt 29 to achieve a minimum reach or distance D of four inches between the sidewall and joist. Obviously, the truss members may be pivoted to intermediate positions between these two extremes to accommodate variations in spacing between the joists and the sidewalls. If the gap between the joist and sidewall should exceed two feet, the adjustable sidewall connection and one-half of the delta joist may be used to accommodate the space. In such event, the adjustable connection and the half-joist should be on opposite sides of the building.

The other ends of the truss members 25 and 26 are connected to the sidewall SW at spaced points along the sidewall by use of T-shaped brackets 30 and 31 suitably affixed to the wall, and angled plates 32 and 33 secured on the ends of the truss members 25 and 26, respectively. Bolts 34 and 35 are extended through the plates 32 and 33 and the associated brackets 30 and 31 to provide a pivotal connection between the truss members and the brackets.

As seen in FIG. 2, truss members 25 and 26 from each of two adjoining locations or brackets 21 and 21A on the joist 11 are connected to a common bracket 30, 31, etc. on the sidewall. Consequently, because of the angular connection of the truss members to the sidewall, the joists 11 are braced against movement either horizontally or perpendicularly relative to the plane of the wall.

Additionally, a bottom chord tie extension or brace member 40 is connected between the end of each bottom chord tie 16 and a bracket 41. secured on the adjacent sidewall SW. The bottom chord tie extension 40 comprises a section of angle iron having holes 42 formed therethrough along its length, and is secured to the end of the bottom chord tie and the bracket 41 by means of bolts 43 extended through one or more of the holes 42 and aligned openings in the bracket and bottom chord tie, respectively.

With this arrangement, the end of each bottom chord tie 16 is connected to the sidewall at three points A, B and C spaced vertically and horizontally on the wall, achieving a three-point connection which braces the joist against movement in directions both parallel and perpendicular to the plane of the wall. The bottom chord tie extension also provides support to the sidewall. The space between the joists and sidewall is thus taken up while maintaining the diaphragm strength inherent in the main structural system.

By simply loosening the bolts 29 and 34, 35, the truss members 25, 26 may be pivoted upwardly or downwardly, as necessary to adjust the distance D spanned by the truss members. Similarly, by removing bolts 43 and repositioning the bottom chord tie extension longitudinally relative to the associated bottom chord 16, the horizontal reach of the bottom chord tie extension may be adjusted. Thus, the adjustable sidewall truss connection of the invention may quickly and easily accommodate variations in the space between joists and sidewalls, and permits use of the joists in buildings wherein the sidewalls are spaced apart by dimensions not divisible by four and without requiring the use of custom parts to span the space. Moreover, the unique sidewall truss connection of the invention provides a stronger structure than is obtained with prior art systems.

The brackets 21, 21A, etc. may be welded, bolted or otherwise suitably fixed to the joist, and the angled plates on opposite ends of the truss members 25, 26 may similarly be welded, bolted or otherwise suitable fixed to the truss members. The brackets affixed to the sidewall SW may be secured by suitable concrete anchors or other fasteners as required.

In a typical construction embodying the principles of the invention, the truss members 25 and 26 may comprise $1\frac{3}{4}\times1\frac{3}{4}\times\frac{1}{8}$ lengths of angle iron, or $2\times2\times\frac{1}{8}$, and the bottom chord tie extensions 40 may comprise $1\frac{1}{4}\times1\frac{1}{4}\times\frac{1}{8}$ lengths of angle iron.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. In a joist structure for spanning the distance between spaced walls of a building, wherein the joist has upper and lower chords and diagonally extending webs interconnecting the chords, the improvement comprising:

adjustable means for connecting the joist and a sidewall of the building, said adjustable means including at least two elongate brace members connected at one of their ends to substantially the same location on said joist and diverging outwardly therefrom at their other ends to spaced points of attachment to the sidewall, thereby bracing the joist against movement parallel to the plane of the sidewall and providing support to the sidewall in a direction perpendicular to the plane of the sidewall.

2. A joist structure as claimed in claim 1, wherein:

said brace members are connected at their opposite ends so as to allow pivotal adjustment thereof to accommodate variations in spacing between the joist and sidewall.

3. A joist structure as claimed in claim 1, wherein:

there are three elongate brace members connected at one of their ends to a substantially common location on the joist and diverging at their other ends for connection to three spaced apart locations on the sidewall.

4. A joist structure as claimed in claim 3, wherein:

elongate chord ties extend beneath the bottom chords in the truss transversely to the longitudinal axis of the chords and perpendicular to the plane of the sidewall; and said brace members are connected to the joist at the end of said chord ties.

5. A joist structure as claimed in claim 4, wherein:

two of said brace members comprise a pair of upwardly and outwardly diverging truss members pivotally connected at one of their ends to a bracket at the end of said chord tie and pivotally connected at their other ends to brackets secured to said sidewall at spaced locations thereon, said sidewall brackets being spaced approximately one-half the distance between adjacent chord ties on the joist; and one truss member of each of adjoining pairs is connected to a common sidewall bracket.

6. A joist structure as claimed in claim 5, wherein:

the third of said brace members comprises a chord tie extension adjustably connected at one end to an adjacent end of the bottom chord tie and extending horizontally therefrom in substantial axial alignment with the bottom chord tie to a connection at its other end with a bracket fixed to the sidewall.

7. A joist structure as claimed in claim 6, wherein:

an angled plate is fixed to each end of each truss member; and a bolt is extended through each said plate and through the bracket at the respective ends of the truss members.

* * * * *